US006634160B1

(12) United States Patent
Brauckmann-Towns

(10) Patent No.: US 6,634,160 B1
(45) Date of Patent: Oct. 21, 2003

(54) COMBINATION SURCINGLE AND WEIGHTED TRAINING DEVICE

(76) Inventor: Krista K. Brauckmann-Towns, 6N777 Palomino Dr., St. Charles, IL (US) 60175

( * ) Notice: Subject to any disclaimer, the term of this patent is extended or adjusted under 35 U.S.C. 154(b) by 0 days.

(21) Appl. No.: 10/254,687

(22) Filed: Sep. 25, 2002

(51) Int. Cl.[7] ..... B68C 1/00; B68C 3/08
(52) U.S. Cl. ..... 54/71; 54/23; 54/66
(58) Field of Search ..... 54/1, 6.1, 23, 66, 54/71

(56) References Cited

U.S. PATENT DOCUMENTS

| | | | | | |
|---|---|---|---|---|---|
| 77,234 | A | | 4/1868 | York | |
| 218,217 | A | | 8/1879 | Benoit | |
| 523,534 | A | * | 7/1894 | Le Count | 54/23 |
| 530,864 | A | | 12/1894 | Torrey | |
| 602,003 | A | * | 4/1898 | Fretwell | 54/66 |
| 2,468,811 | A | | 5/1949 | Carroll | |
| 5,127,213 | A | | 7/1992 | Petronio | |
| 5,519,986 | A | * | 5/1996 | Raffit | 54/71 |
| 5,755,185 | A | * | 5/1998 | Gallagher | 54/71 |
| 6,352,053 | B1 | | 3/2002 | Records | |

* cited by examiner

*Primary Examiner*—Charles T. Jordan
*Assistant Examiner*—Elizabeth Shaw
(74) *Attorney, Agent, or Firm*—Charles F. Meroni, Jr.; Meroni & Meroni, P.C.

(57) ABSTRACT

A weighted training surcingle device comprising a belt simulating the spatial area of a person's legs and buttocks. Each half of the belt has a plurality of pouches providing means for holding weight adjacent the rib cage of a horse simulating weight distribution of a person. Rings interspaced between the pouches are supplied for attaching at least one line to the belt for the training of a horse. A pad distributes weight away from a spinal area of a horse when the belt is placed upon a horse. A centrally located pouch spanning the midpoint of the belt is provided for holding weight adjacent the spine of the horse simulating body weight of a person. A line is attached between one of the different rings of the belt and a guiding ring of a bridle to restrict movement of the horse's head within the bridle.

24 Claims, 6 Drawing Sheets

COMBINATION SURCINGLE AND WEIGHTED TRAINING DEVICE

BACKGROUND OF THE INVENTION

1. Field of the Invention

The present invention generally relates to horse training devices. More specifically, the present invention relates to a combination surcingle and weighted training device.

2. Description of the Prior Art

Horses have been used for thousands of years to carry people and articles. Horses typically need to be trained in order to carry weight upon the horse's back. Several different types of training devices have been devised in the past for introducing weight to a horse so that the horse can become accustom to carrying weight upon the horse's back. A few of these devices are disclosed here.

U.S. Pat. No. 530,864 issued to Torrey discloses a weighted saddle blanket having a plurality of weighted strips disposed through out the blanket.

U.S. Pat. No. 5,127,213 issued to Petronio discloses a blanket-type member supports weights in either a fixed or variable relation and is disposed on the back of an animal for training and conditioning purposes. The blanket-type member has a cushioned undersurface for the comfort of the animal and is disposed on the animal's back over an undercover to prevent chafing and the like as the animal moves about with the blanket-type member on its back.

U.S. Pat. No. 6,352,053 issued to Records discloses a pack saddle designed to simulate the weight and feel of an actual rider for testing an animal's propensity to buck. While the animal's movement is restricted, the simulated rider pack saddle is placed over the back of the animal and cinched in place with a strap that is remotely releasable. After attaching the apparatus, the animal is released and observed to determine its natural propensity to buck.

U.S. Pat. No. 2,468,811 issued to Carroll discloses a surcingle having structure for carrying weight, in addition to that of a jockey, in the form of lead weights. The lead weights are placed within interspaced pouches along the length of the surcingle.

Each of these prior art references discloses or teaches using weight upon a horse or similar animal to make them accustom to carrying people or articles upon the animal's back. However, there is still a remaining need for a weighted training device that more closely simulates the weight distribution of a person riding a horse or like animal while simultaneously providing means for attaching a training line or rein to the device for behavioral training.

It is also common practice to train horses so that they move in a certain manner. There have been several different types of training devices developed for training the movement of a horse using training lines and or reins. An example of this is U.S. Pat. No. 77,234 issued to York that discloses a surcingle used to train the movement of the horse's feet as the horse moves. However, if an animal trainer using the surcingle desired to simultaneously train the movement of the horse or like animal while making the horse accustom to weight upon the back of the animal, the animal trainer would have to use a second device such as the weight training device previously disclosed.

Accordingly, there remains a need for a weighted training device that more closely simulates the weight distribution of a person riding a horse or like animal while simultaneously providing means for attaching a training line or rein to the device for controlling the movement of the horse.

SUMMARY OF THE INVENTION

To fulfill the need still present in the prior art, the claimed invention provides a combination surcingle and weighted training device that more closely simulates the weight distribution of a person riding a horse or like animal being trained while simultaneously providing means for attaching training lines or reins to the device to train movement of the horse.

The weighted training surcingle device generally comprises a belt, a pair of pads, a first and second set of weight pouches, and a plurality of D shaped receiving rings.

The belt is side sized and shaped to simulate the spatial area of the legs and buttocks of a person straddling the back of a horse or like animal. The belt has a midpoint for positioning adjacent the spine of a horse that divides the belt into a first half for positioning adjacent a first rib cage portion of the horse and a second half for positioning adjacent an opposite rib cage portion of the horse.

The pair of pads on the bottom side of the belt and adjacent the midpoint of the belt act to distribute weight away from the spine of the horse when weight is placed in the pouches of the device helping to protect the spine of the horse.

The weight pouches attached to the top side of the belt provide means for holding weight adjacent the rib cage of the horse. Using two pouches on either side of the midpoint to provide means for holding weight allows the weight to be more evenly vertically distributed and helps to more realistically simulate the weight distribution of a person when a person sits upon the horse.

The receiving rings are spaced about the device to provide a user of the device numerous point of attachment for training lines so that many different types of training routines can be performed.

The centrally located weight pouch attached to the top side of the belt and spanning the midpoint of the belt provides means for holding weight adjacent the spine of the horse.

BRIEF DESCRIPTION OF THE DRAWINGS

FIG. 1 shows a perspective view of the combination surcingle and weighted training device.

FIG. 2 shows a cross sectional view of the weight pouches of the combination surcingle and weighted training device.

FIG. 3 shows a perspective view of the device being worn by a horse without a saddle.

FIG. 4 shows how the nylon weight bags are placed inside the weight pouches.

FIG. 5 shows how an additional weight pouch can be added to the device.

FIG. 6 shows how the device can be used in conjunction with a saddle.

DETAILED DESCRIPTION OF THE PREFERRED EMBODIMENT

Figure 1:
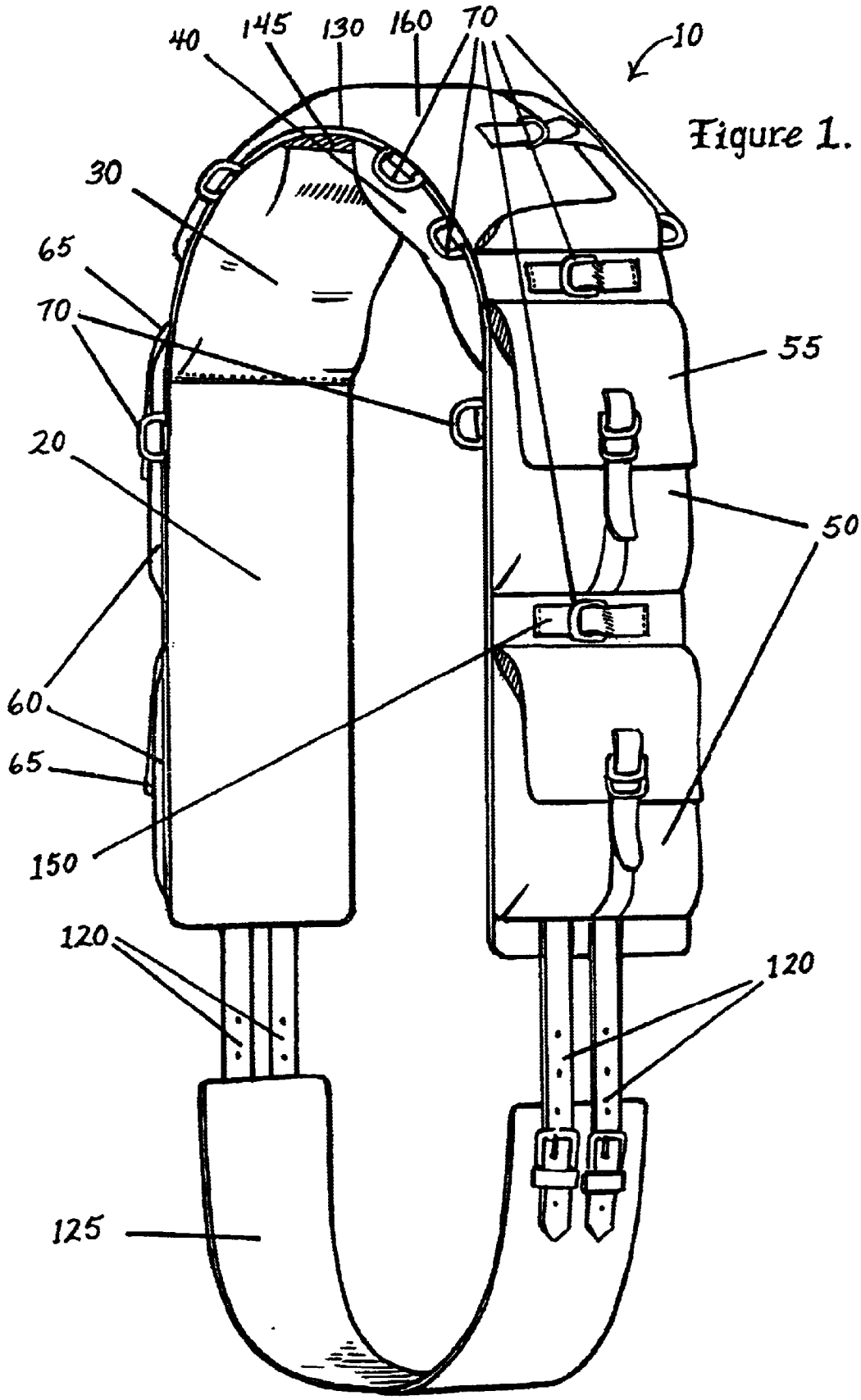
FIG. 1.
Figure 2:
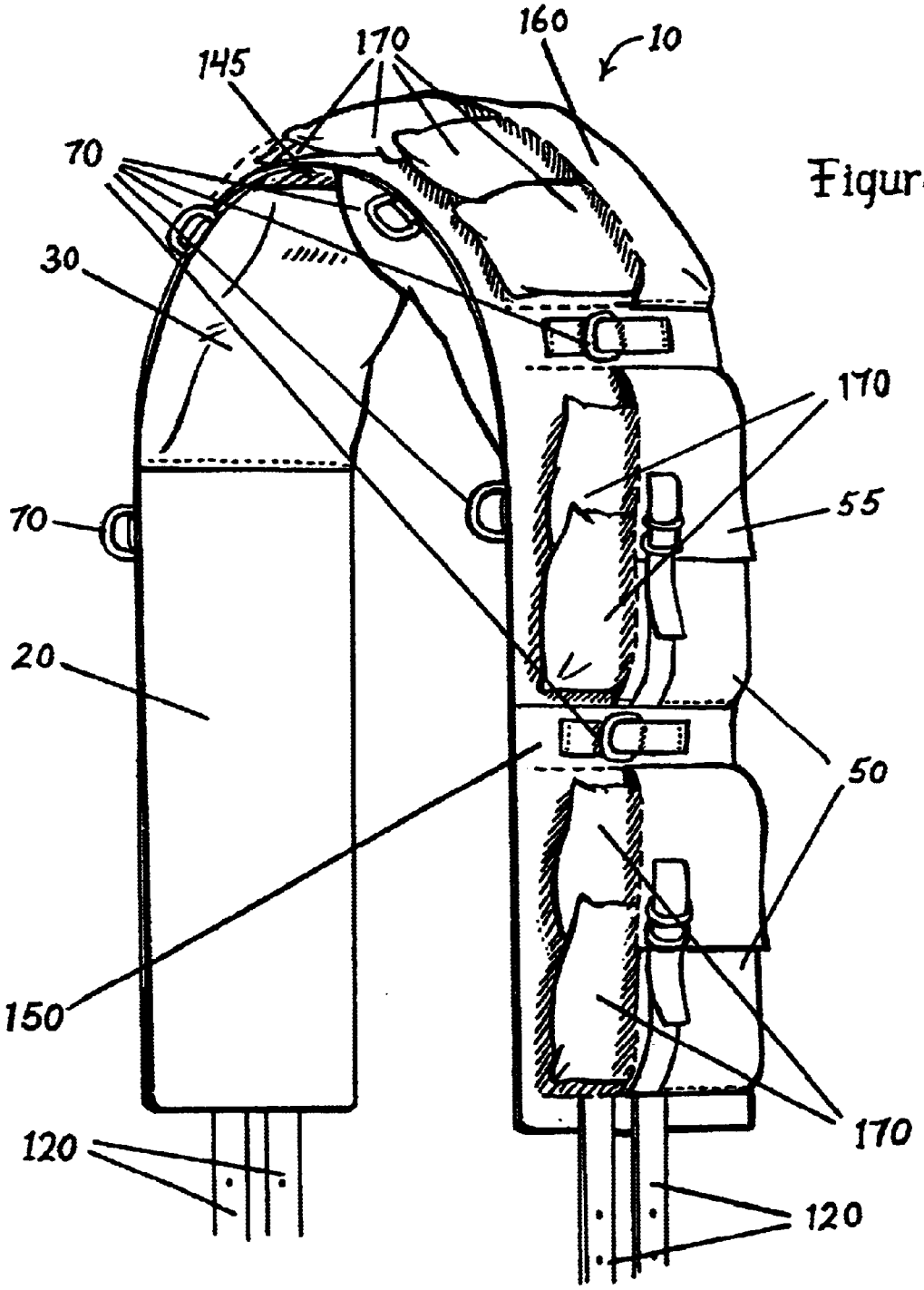
FIG. 2.

Turning now to the drawings, a weighted training surcingle device 10 is shown in FIGS. 1 and 2. The weight training surcingle device 10 generally comprises a belt 20, a first pad 30 and second pad 40, a first set 50 and second set 60 of weight pouches, and a plurality of D shaped receiving rings 70.

The belt 20 of the device is sized and shaped to simulate the spatial area of the legs and buttocks of a person riding a horse 80 and is preferably made of leather or other similar material such as canvas. The belt 20 shown in FIGS. 1 and 2 is made of ¼ inch thick leather with a width of about 7 inches and a length of about 55 inches. It is contemplated that belts of differing sizes can be used in different applications, with the width of the belt ideally varying between 7 inches and 10 inches.

Figure 3:
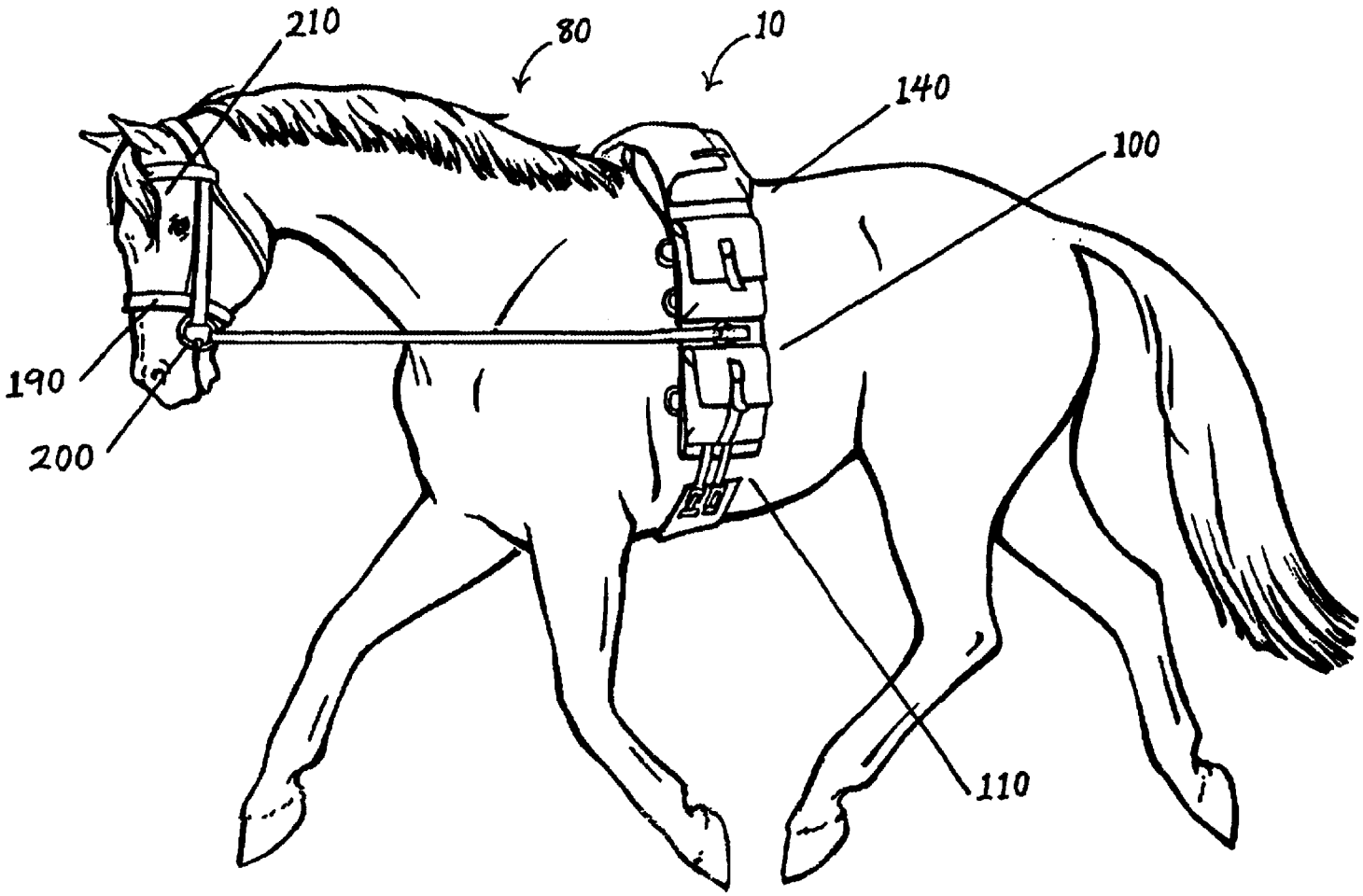
FIG. 3.

The width of the belt 20 shown in FIGS. 1 and 2 is roughly twice the width of a typical surcingle to provide space for attachment of the weight pouches 50, 60 and to distribute weight placed within the weight pouches 50, 60 across an area substantially equal to the typical area of contact that a rider's legs and buttocks would have with the saddle 90 and rib cage 100 of a horse 80. The belt 20 is secured about the midriff 110 of the horse 80 by a pair of 12½ inch long straps 120 on either end of the belt 20 that can be connected to a second belt 125. When the device 10 is placed upon the horse 80, the midpoint 130 of the belt 20 should be positioned adjacent the spine 140 of the horse 80 as shown in FIG. 3. The midpoint 130 of the belt 20 divides the belt 20 into halves with each half of the belt 20 being positioned adjacent opposite rib cage 100 of the horse 80. The belt 20 preferably has a steel plate gullet 145 within the belt 20 spanning the midpoint 130 of the belt 20 so that weight from the device 10 will be distributed away from the spine 140 of the horse 80 and toward the sides of the horse 80 through the pads 30, 40. However, other rigid materials such as plastic or cardboard may be used to perform the function of the steel gullet.

A pair of pads 30, 40 on the bottom side of the belt 20 and adjacent the midpoint 130 of the belt 20 act to distribute weight away from the spine 140 of the horse 80 when weight is placed in the pouches 50, 60 of the device 10 helping to protect the spine 140 of the horse 80. The pads 30, 40 shown in FIGS. 1 and 2 are about 6½ inches wide and about 7½ inches long. The pads 30, 40 are preferably made of leather or other durable materials such as canvass or nylon webbing and are stuffed with padding such as foam to a thickness of about 1½ inches.

The weight pouches 50, 60 attached to the top side of the belt 20 provide means for holding weight adjacent the rib cage 100 of the horse 80. Using two pouches on either side of the midpoint 130 to provide means for holding weight allows weight to be more evenly vertically distributed and helps to more realistically simulate the weight distribution of a person when a person sits upon the horse. The use of two weight pouches also provides space between the pouches 150 for placement of receiving rings 70 enabling a user of the device 10 greater flexibility in connecting training lines to the device 10. The pouches 50, 60 shown in FIGS. 1 and 2 are about 6½ inches in width, about 7½ inches in length, and about 2 inches in depth. Each of the pouches 50, 60 have flapped openings 55, 65 that open upwardly when the device 10 is placed upon a horse 80 or like animal. The pouches 50, 60 are preferably made of leather, but may be made of other similar materials such as canvass or nylon based cloth.

The receiving rings 70 are spaced about the device 10 to provide a user of the device 10 numerous point of attachment for training lines or reins so that many different types of training routines can be performed. The receiving rings 70 are preferably 1½ inch case hardened steel D rings as shown in FIGS. 1 and 2. It is contemplated that other types and sizes of receiving rings 70 can be used to accomplish the tasks that the D rings accomplish shown in the illustrated embodiment.

Figure 5:
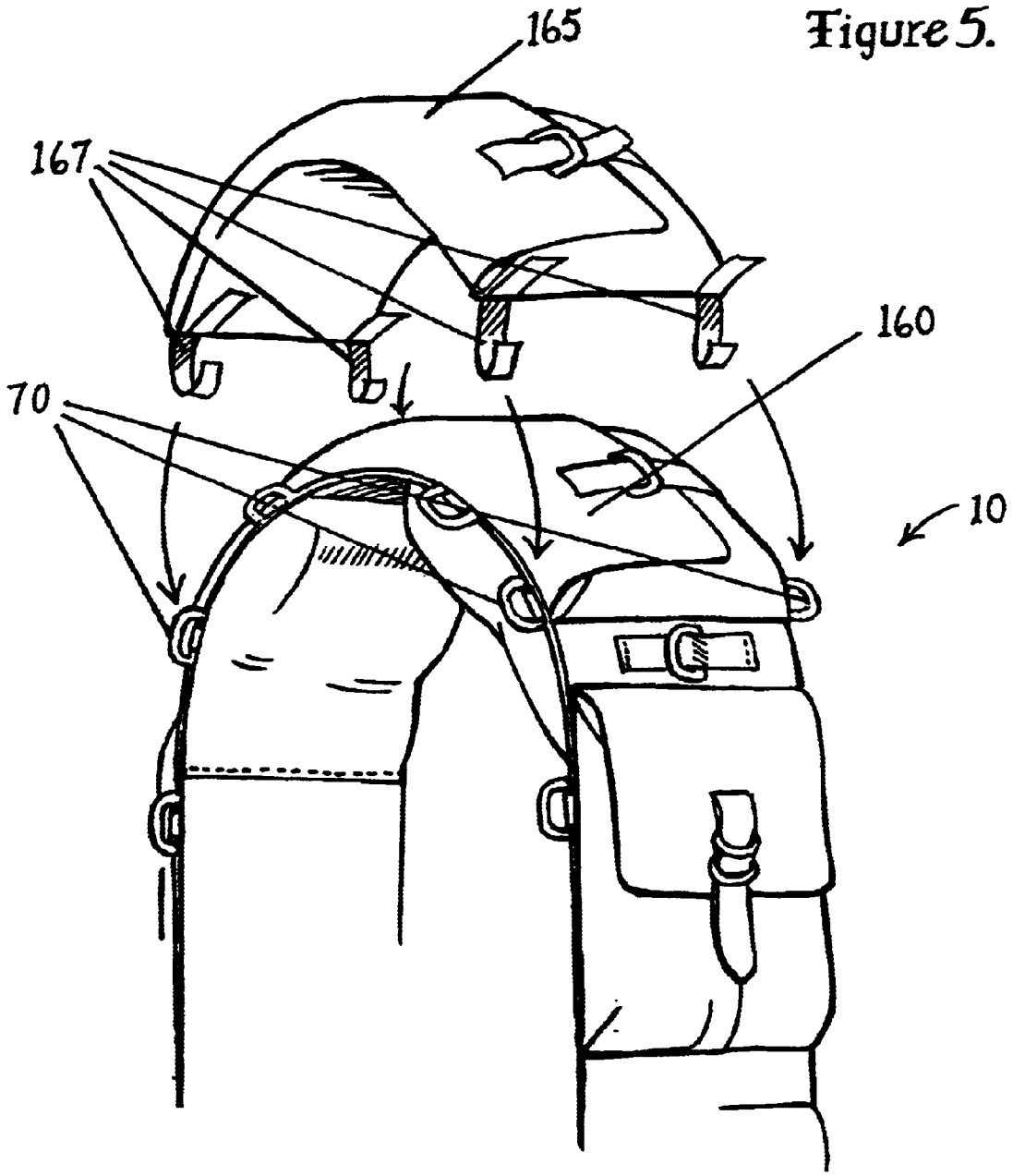
FIG. 5.

A centrally located weight pouch 160 attached to the top side of the belt 20 and spanning the midpoint 130 of the belt 20 provides means for holding weight adjacent the spine 140 of the horse 80. The pouch 160 shown in FIGS. 1 and 2 is about 6½ inches in width, about 13 inches in length, and about 3 inches in depth. The centrally located pouch 160 is preferably made of leather, but may be made of other similar materials such as canvass or nylon based cloth. FIG. 5 shows that an additional weight pouch 165 may be attached over the centrally located weight pouch 160 by attaching the additional weight pouch 165 to the receiving rings 70 by way of the connecting straps 167.

Figure 4:
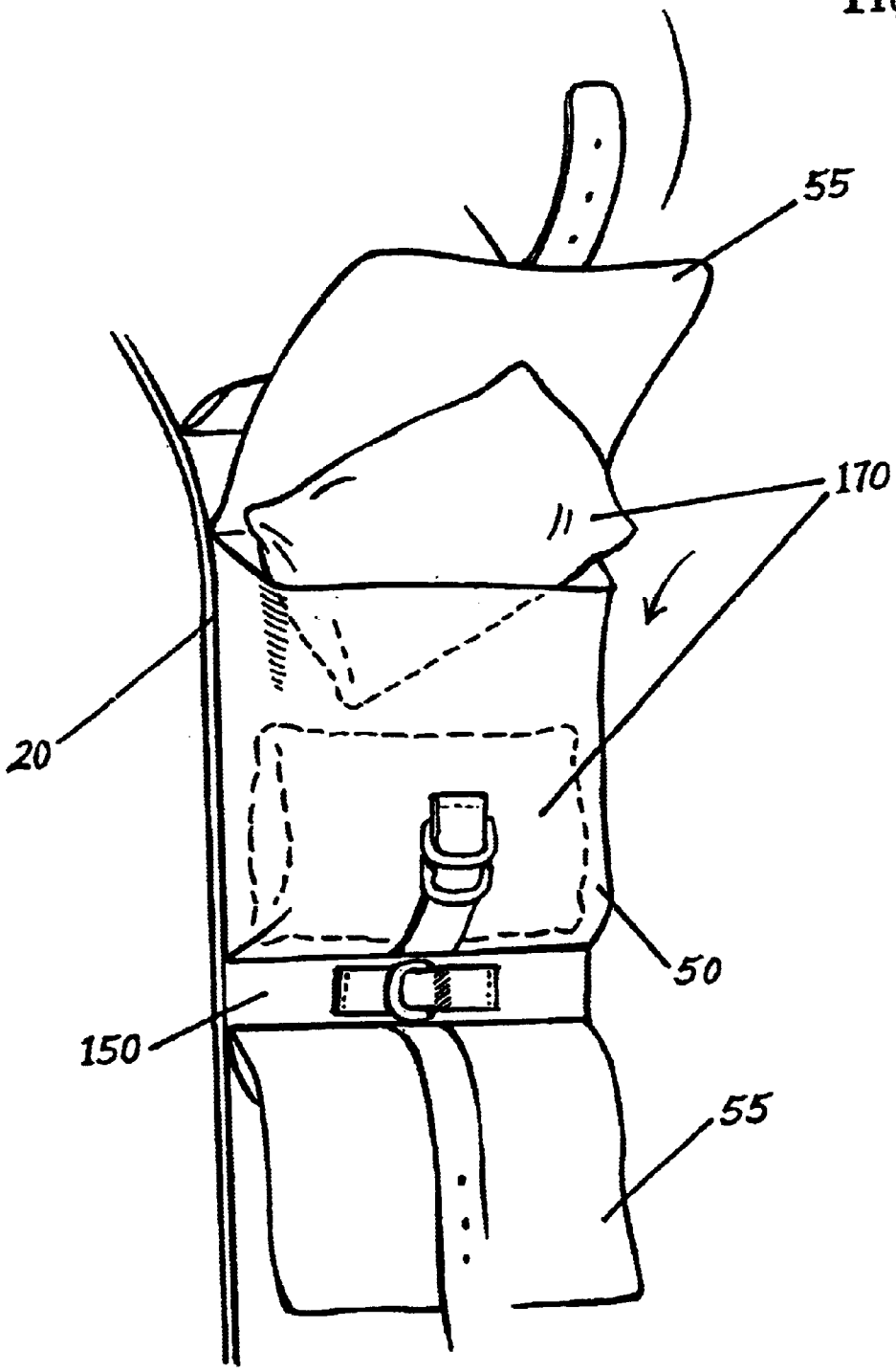
FIG. 4.
Figure 6:
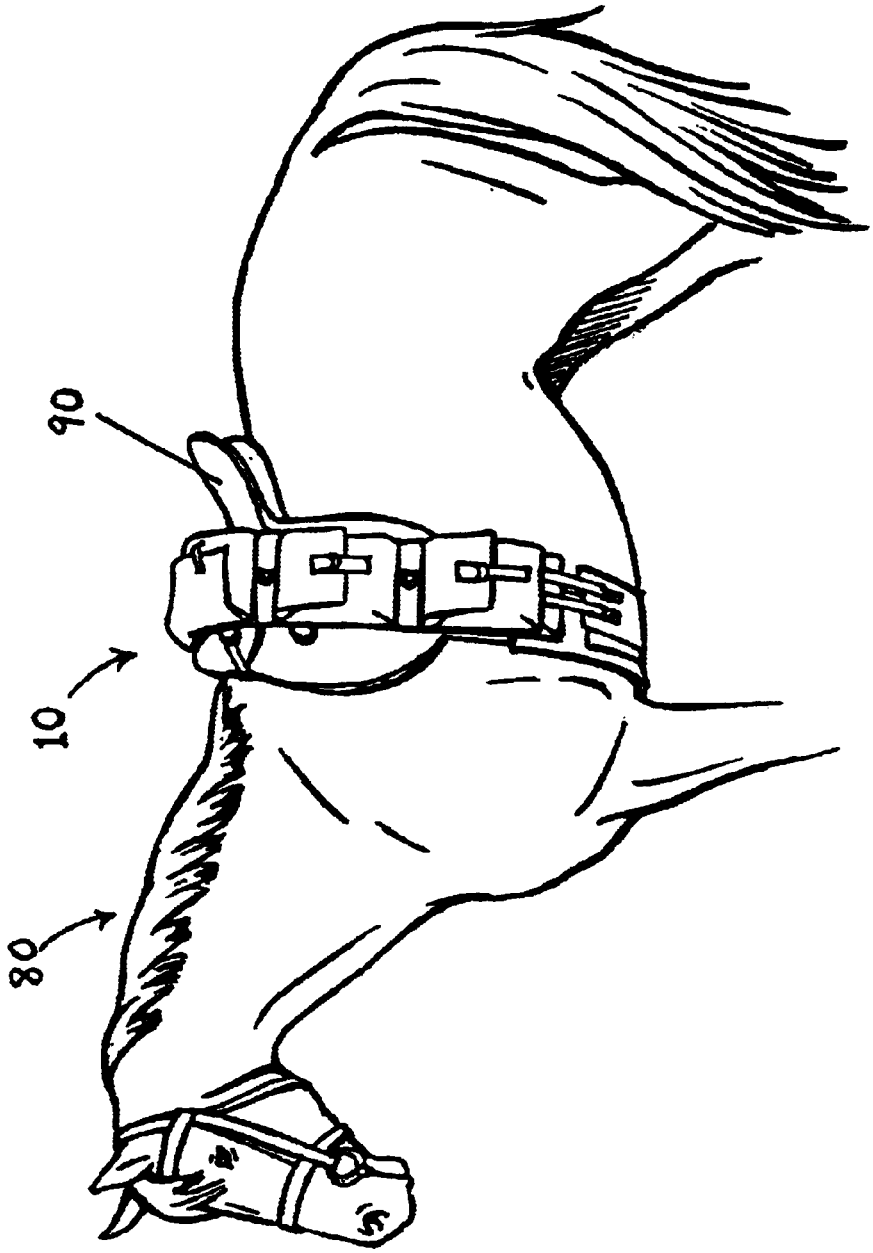
FIG. 6.

A variety of different types of weighting material can be used to provide weight for the weighted training device 10. The device 10 as shown in FIG. 2 is capable of holding 140 pounds of steel shot sized pellets. Preferably, nylon bags 170 containing a discrete amount of steel shot are used to facilitate calculating the amount of weight contained within the weight pouches 50, 60 and to also facilitate easy addition and reduction of weight held by the device 10. FIG. 4 shows how the nylon bags 170 are placed within the pouches 50. The device 10 can also be used in combination with other commonly used horse equipment such as a bridle 190 and bit 200 as shown in FIG. 3. The combined use of the bit 200 and bridle 190 with the device 10 allows the person training the horse 80 to restrict the movement of the horse's head 210 while simultaneously introducing the horse 80 to the sensation of added weight to the horse's back. FIG. 6 shows how the device 10 can be used with a saddle 90. The device 10 can be positioned over the saddle 90 in substantially the same position as a person's legs and buttocks when a person sits on the saddle 90.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A weighted training surcingle device in combination with a bridle, the combination comprising:

a belt from about 7 inches to about 10 inches in width having a top side and a bottom side sized and shaped to simulate spatial area of legs and buttocks of a person;

a pad attached to the bottom of the belt distributing weight away from a spinal area of a horse when the belt is placed upon a horse;

a plurality of spaced pouches attached to the top side of the belt providing means for holding weight adjacent a horse rib cage;

a plurality of receiving rings interspaced between the pouches for attaching at least one line to the belt for training of a horse;

a bridle sized and shaped for placement about a horse head;

at least one guiding ring attached to the bridle;

a line connecting the guiding ring and at least one ring of the plurality of rings, the plurality of rings interspaced between the pouches providing means for altering the angular displacement of the line thereby restricting movement of a horse head within the bridle to differing ranges of motion.

2. The combination of claim 1 further comprising a rigid plate positioned within the belt for placement adjacent a spinal area of a horse.

3. The combination of claim 2 further comprising a plurality of weights sized and shaped to fit within the pouches.

4. The combination of claim 3 further comprising an attachable weight pouch providing means for holding weight, the attachable weight pouch being attached to at least one of the receiving rings.

5. The combination of claim 4 wherein the plurality of spaced pouches further comprise a flapped opening with upwardly displaceable flaps.

6. The device of claim 5 wherein the pouches comprises an upper pouch being positioned to simulate thigh weight distribution of a person and a lower pouch being positioned to simulate calf weight distribution of a person, at least one of the plurality of receiving rings being positioned between the upper pouch and lower pouch.

7. The combination of claim 6 wherein the pouches further comprise a centrally located pouch attached to a top side of the belt spanning a spinal area of a horse when the belt is placed across a back portion of a horse, the centrally located pouch simulating body weight of a person.

8. A weighted training surcingle device, the device comprising:

a belt having a top side and a bottom side sized and shaped to simulate a spatial area of legs and buttocks of a person, the belt having a midpoint for positioning adjacent a spinal area of a horse dividing the belt into a first half for positioning adjacent a first flank of a horse and a second half for positioning adjacent a second flank of a horse;

a first pad adjacent the midpoint of the belt-attached to the bottom side of the first half of the belt;

a first plurality of spaced pouches attached to the top side of the first half of the belt, the spaced pouches providing means for holding weight adjacent a first flank of a horse simulating leg weight distribution of a person;

a first plurality of receiving rings interspaced between the first plurality of spaced pouches for attaching at least one line to the belt for training of a horse;

a second pad adjacent the midpoint of the belt attached to the bottom side of the second half of the belt and opposite to the first pad, the first and second pads coacting to distribute weight away from a spinal area of a horse when the belt is placed upon a horse;

a second plurality of spaced pouches attached to the top side of the second half of the belt, the spaced pouches providing means for holding weight adjacent a second flank of a horse simulating leg weight distribution of a person;

a second plurality of receiving rings interspaced between the second plurality of spaced pouches for attaching at least one line to the belt for training of a horse;

a centrally located pouch attached to the top side of the belt and spanning the midpoint of the belt for holding weight adjacent a spinal area of a horse simulating body weight of a person.

9. The device of claim 8 wherein the belt has a width of from about 7 inches to about 10 inches.

10. The device of claim 9 further comprising a rigid plate adjacent the centrally located pouch spanning the midpoint of the belt.

11. The device of claim 10 further comprising an attachable weight pouch providing means for holding weight, the attachable weight pouch being attached to at least one of the receiving rings.

12. The device of claim 11 further comprising a plurality of weights sized and shaped to fit within the first and second pluralities of pouches.

13. The device of claim 12 wherein the first plurality of spaced pouches comprises an upper pouch being positioned to simulate thigh weight distribution of a person and a lower pouch being positioned to simulate calf weight distribution of a person, at least one receiving ring of the first plurality of receiving rings being positioned between the upper pouch and lower pouch.

14. The device of claim 12 wherein the first plurality of spaced pouches comprises an upper pouch being positioned to simulate thigh weight distribution of a person and a lower pouch being positioned to simulate calf weight distribution of a person, at least one receiving ring of the first plurality of receiving rings being positioned between the upper pouch and lower pouch.

15. A weighted training surcingle device in combination with a bridle, the combination comprising:

a weighted belt sized and shaped to simulate weight distribution of a person seatedly straddling an object, the belt having a midpoint for positioning adjacent a spinal area of a horse;

a pad attached to the weighted belt for distributing weight away from a spinal area of a horse when the weighted belt is placed upon a horse;

a plurality of receiving rings spaced about the midpoint of the belt for attaching at least one line to the belt for training of a horse;

a bridle sized and shaped for placement about a horse head;

at least one guiding ring attached to the bridle;

a line connecting the guiding ring and at least one receiving ring of the plurality of receiving rings, the plurality of receiving rings spaced about the belt providing means for altering the angular displacement of the line thereby restricting movement of a horse head within the bridle to differing ranges of motion.

16. The combination of claim 15 further comprising a rigid plate positioned within the belt for placement adjacent a spinal area of a horse.

17. The combination of claim 16 farther comprising an attachable weight pouch providing means for holding weight, the attachable weight pouch being attached to at least one of the receiving rings.

18. The combination of claim 16 wherein the weighted belt has a width of about 7 inches to about 10 inches.

19. The combination of claim 18 wherein the weighted belt has a plurality of pockets attached to the belt evenly distributed about the midpoint of the belt, the pouches providing means for holding weight adjacent a horse rib cage.

20. The combination of claim 6, wherein the plurality of pockets comprise an upper pocket being positioned on the belt to simulate thigh weight distribution of a person and a lower pocket being positioned to simulate calf weight distribution of a person, at least one receiving ring of the plurality of receiving rings being positioned between the upper pocket and the lower pocket.

21. A weighted training surcingle device, the device comprising:

a belt having a top side and a bottom side sized and shaped to simulate a spatial area of legs and buttocks of a person, the belt having a midpoint for positioning adjacent a spinal area of a horse dividing the belt into a first half for positioning adjacent a first flank of a horse and a second half for positioning adjacent a second flank of a horse;

a rigid plate within the belt spanning the midpoint of the belt;

a first pad adjacent the midpoint of the belt attached to the bottom side of the first half of the belt;

a first plurality of spaced pouches attached to the top side of the first half of the belt, the spaced pouches providing means for holding weight adjacent a first flank of a horse simulating leg weight distribution of a person;

a first plurality of receiving rings interspaced between the first plurality of spaced pouches for attaching at least one line to the belt for training of a horse;

a second pad adjacent the midpoint of the belt attached to the bottom side of the second half of the belt and opposite to the first pad, the first and second pads coacting to distribute weight away from a spinal area of a horse when the belt is placed upon a horse;

a second plurality of spaced pouches attached to the top side of the second half of the belt, the spaced pouches providing means for holding weight adjacent a second flank of a horse simulating leg weight distribution of a person;

a second plurality of receiving rings interspaced between the second plurality of spaced pouches for attaching at least one line to the belt for training of a horse;

a centrally located pouch attached to the top side of the belt and spanning the midpoint of the belt for holding weight adjacent a spinal area of a horse simulating body weight of a person, the centrally located pouch having a flapped opening oriented such that a flap of the flapped opening opens forwardly toward withers of a horse and away from flanks of a horse when placed upon a horse.

22. The device of claim 21 further comprising a plurality of deformable weight bags sized and shaped to fit within the first and second pluralities of pouches having a plurality of pellet shaped weight objects within the deformable weight bags.

23. The device of claim 22 wherein the belt has a width of from about 7 inches to about 10 inches.

24. The device of claim 23 further comprising an attachable weight pouch providing means for holding weight, the attachable weight pouch being attached to at least one of the receiving rings.

* * * * *